US007705706B2

(12) United States Patent
Ding

(10) Patent No.: US 7,705,706 B2
(45) Date of Patent: Apr. 27, 2010

(54) PLUG WITH REPLACEABLE FUSE

(75) Inventor: Feng Ding, Guang Dong Province (CN)

(73) Assignee: Yun Meng Yun Xi Lighting Products Co Ltd, Hubei (CN)

( * ) Notice: Subject to any disclaimer, the term of this patent is extended or adjusted under 35 U.S.C. 154(b) by 288 days.

(21) Appl. No.: 11/760,798

(22) Filed: Jun. 11, 2007

(65) Prior Publication Data

US 2008/0303625 A1 Dec. 11, 2008

(51) Int. Cl.
*H01H 85/143* (2006.01)
*H01H 85/165* (2006.01)
*H01H 85/54* (2006.01)
*H01R 13/68* (2006.01)

(52) U.S. Cl. ..... 337/261; 439/620.31; 439/620.3; 337/211; 337/255; 337/208; 337/198

(58) Field of Classification Search ..... 337/208, 337/198, 211, 255, 261; 439/620.3, 620.31
See application file for complete search history.

(56) References Cited

U.S. PATENT DOCUMENTS 3,976,967 A * 8/1976 Magherini ..... 337/211
4,178,061 A * 12/1979 Ahroni ..... 439/620.29
4,379,278 A * 4/1983 Kuczynski et al. ..... 337/91
4,592,613 A * 6/1986 Tong ..... 439/620.31
5,176,539 A * 1/1993 Liu ..... 439/620.29
5,248,954 A * 9/1993 Chiang ..... 337/66
5,249,986 A * 10/1993 Lu ..... 439/620.34
5,320,563 A * 6/1994 Liao ..... 439/620.34
5,435,755 A * 7/1995 Chien et al. ..... 439/620.29
5,451,173 A * 9/1995 Mai ..... 439/620.29
5,457,445 A * 10/1995 Su ..... 337/198
5,482,478 A * 1/1996 Liao ..... 439/620.29
5,513,063 A * 4/1996 Wu ..... 361/105
5,633,618 A * 5/1997 Chuang ..... 337/56
5,637,017 A * 6/1997 Hsu ..... 439/620.29
5,643,012 A * 7/1997 Mai et al. ..... 439/620.29
5,704,811 A * 1/1998 Hsu ..... 439/620.29
5,742,219 A * 4/1998 Moalem et al. ..... 337/68
5,783,986 A * 7/1998 Huang ..... 337/348
5,791,941 A * 8/1998 Wang ..... 439/620.29
5,798,683 A * 8/1998 Lin et al. ..... 337/198
5,851,127 A * 12/1998 Huang ..... 439/620.29
5,853,301 A * 12/1998 Wang ..... 439/620.29
5,861,794 A * 1/1999 Pellon ..... 337/365
5,876,250 A * 3/1999 Deng ..... 439/620.3

(Continued)

*Primary Examiner*—Jayprakash N Gandhi
*Assistant Examiner*—Bradley H Thomas
(74) *Attorney, Agent, or Firm*—Jianq Chyun IP Office

(57) ABSTRACT

A plug with a replaceable fuse is provided. The plug includes an outer housing, an inner core, a pair of prongs and a pair of conductive cords. The outer housing includes a fuse uninstall button opening and an inner core install opening. The inner core is installed into the outer housing through the inner core install opening, and the inner core includes a fuse socket and a fuse uninstall button. The fuse socket has an uninstall opening. When it is intended to replace the fuse, the fuse uninstall button is pressed from the fuse uninstall button opening, the fuse is ejected or pushed out of the fuse socket by one end of the fuse uninstall button extending to the uninstall opening. When the fuse uninstall button is not pressed, the fuse uninstall button restores to the original position, such that a new fuse is installed into the fuse socket.

14 Claims, 15 Drawing Sheets

U.S. PATENT DOCUMENTS 5,906,515 A * 5/1999 Lin ..... 439/620.3
5,938,477 A * 8/1999 Yen ..... 439/620.31
5,984,730 A * 11/1999 Lu ..... 439/620.3
6,039,607 A * 3/2000 Cheung ..... 439/620.31
6,062,883 A * 5/2000 Schreiber et al. ..... 439/159
6,190,207 B1 * 2/2001 Wang ..... 439/620.31
6,267,627 B1 7/2001 Lin
6,383,026 B1 * 5/2002 Chen ..... 439/620.32
6,468,111 B1 * 10/2002 Weng ..... 439/620.3
6,692,291 B2 * 2/2004 Chen ..... 439/417
6,780,061 B1 * 8/2004 Gibboney ..... 439/620.27
6,814,621 B2 * 11/2004 Lu ..... 439/620.29
6,869,313 B2 * 3/2005 Gibboney ..... 439/620.15
6,872,089 B1 * 3/2005 Chen ..... 439/417
7,021,968 B1 * 4/2006 Lu ..... 439/620.07
7,048,557 B2 * 5/2006 Yen ..... 439/140
2004/0145446 A1 * 7/2004 Chou ..... 337/36

* cited by examiner

PLUG WITH REPLACEABLE FUSE

BACKGROUND OF THE INVENTION

1. Field of the Invention

The present invention relates to a plug with a replaceable fuse. More particularly, the present invention relates to a plug with an easily replaceable fuse.

2. Description of Related Art

A common plug may cause a problem that a conductive cord or an electrical appliance is burnt out due to the excessively large output power of the power source, which is caused by too many electrical appliances being externally connected with the plug. Therefore, many manufacturers start to manufacture a plug with a fuse. When too many electrical appliances are externally connected, the fuse in the plug will be burned out first, so as to prevent the conductive cord or the electrical appliance from being burned out, thereby further avoiding dangers.

The conventional plug with a fuse is usually designed as a plug with a replaceable fuse, such that after the fuse is burned out, the user can use a tool to uninstall the fuse and install a new fuse. FIG. 1 shows a plug with a replaceable fuse provided in U.S. Pat. No. 6,039,607. The plug includes an outer housing 10, an inner core 11, a pair of prongs 12 and a pair of conductive cords 13. The pair of conductive cords 13 and the pair of prongs 12 are embedded in the outer housing 10, and extend from the inside of the outer housing 10 towards the outside. The outer housing 10 has a fuse socket opening 100, an inner core opening 101, two button openings 102A, 102B, and a fuse socket cover 103. The fuse socket cover 103 is used for opening or closing the fuse socket opening 100. The outer housing 10 is formed with an inner accommodation room, the inner core 11 is installed to the inner accommodation room of the outer housing 10 through the inner core opening 101. The inner core 11 includes a button 110A, a button 110B, and a fuse socket 111. The fuse socket 111 is used for installing a fuse 14. When the fuse 14 is installed in the fuse socket 111, the pair of prongs 12 is coupled to the fuse 14, and the pair of conductive cords 13 is coupled to the fuse 14. The pair of prongs 12 is used to be inserted into the outlet and receive the power. The pair of conductive cords 13 is used to transmit the power to the electrical appliances connected with the pair of conductive cords 13. The fuse 14 includes a metal wire with a low melting point, once the current load is excessively high, the metal wire is burned out, so as to prevent the electrical appliance and the pair of conductive cords 13 from being burned out. The fuse socket 111 is used for disposing the fuse 14. The fuse socket opening 100 is used to provide an opening for moving in or out the fuse 14. The button 110A extends out of the button opening 102A for pushing the fuse 14 installed in the fuse socket 111, such that the fuse 14 is uninstalled from the fuse socket 111. The button 110B extends out of the button opening 102B for pushing the fuse 14 to the fuse socket 111, such that the fuse 14 is coupled to the pair of conductive cords 13 and the pair of prongs 12.

Referring to FIG. 2, FIG. 2 is a schematic view of a replacing method for the fuse 14 of the plug in FIG. 1. When it is intended to replace the fuse 14, a tool is needed (for example, an I-shaped screw driver) to open the fuse socket cover 103. Then, the button 110A is pressed to push the fuse 14 away from the fuse socket 111, and the fuse 14 is moved out of the fuse socket opening 100, such that the fuse 14 is uninstalled. Then, the new fuse 14 is disposed into the inner accommodation room, through the fuse socket opening 100, and the button 110B is pressed to push the fuse 14 to the fuse socket 111. The fuse 14 is coupled to the pair of prongs 12 and the pair of conductive cords 13. Finally, the fuse cover 103 is locked in the fuse socket opening 100 by using a tool, so as to accomplish replacing the fuse 14.

Referring to FIG. 3, FIG. 3A is a top view of a fuse socket cover 103; FIG. 3B is a side view of the fuse socket cover 103; and FIG. 3C is a bottom view of the fuse socket cover 103. The fuse socket cover 103 includes a groove 103A, a group of bumps 103B. The outer housing 10 is disposed with a group of bump grooves for being engaged with the group of bumps 103B, so as to fix the fuse socket cover 103 in the fuse socket opening 111. An I-shaped screw driver is used to rotate the groove 103A to open the fuse socket cover 103 from the fuse socket opening 100 or fix the fuse socket cover 103 in the fuse socket opening 100, so the fuse socket cover 103 can achieve a function of opening and closing the fuse socket opening 100.

FIG. 4 shows a plug with a replaceable fuse provided in U.S. Pat. No. 6,267,627. The plug includes an outer housing 20, a pair of prongs 22 and a pair of conductive cords 23. The outer housing 10 is formed with a plurality of inner accommodation rooms for disposing a fuse 24 and for embedding the pair of prongs 22 and the pair of conductive cords 23. The outer housing is formed with a fuse socket opening 200, and has a fuse cover 203 for opening or closing the fuse socket opening 200. The fuse cover 203 includes two arc-shaped notches 203A and a pair of fuse engaging components 203B. The pair of fuse engaging component 203 form a fuse socket 211. The fuse engaging component 203B is used for fixing the fuse 24 in the fuse socket 211. The pair of conductive cords 23 and the pair of prongs 22 are embedded in the outer housing 20, and extend from the inside of the outer housing 20 towards the outside. When the fuse 24 is installed in the fuse socket 211, and when the fuse socket opening 200 is covered with the fuse cover 203, the pair of prongs 22 and the pair of conductive cords 23 are coupled to the fuse 24. The pair of prongs 22 is used for being inserted in the outlet and receiving power. The pair of conductive cords 23 is used for transmitting the power to the electrical appliances connected with the pair of conductive cords 23. The fuse 24 includes a metal wire with a low melting point, once the current load is excessively high, the metal wire is burned out, so as to prevent the electrical appliance and the pair of conductive cords 23 from being burned out. The fuse socket opening 200 is used to provide an opening for moving in or out the fuse 24. The fuse socket cover 203 is used for opening or closing the fuse socket opening 211. When it is intended to replace the fuse 24, a tool is used to pull up or pry the fuse socket cover 203 from the arc-shaped notch 203A, and thus the fuse socket cover 203 is taken off from the fuse socket opening 211. Then the fuse 24 on the fuse socket cover 203 is taken off from the fuse socket 211. Then, a new fuse 24 is disposed in the fuse socket 211, and the fuse socket opening 200 is covered with the fuse socket cover 203, so as to accomplish the replacing of the fuse 24.

Based on the above, a tool is required for the conventional plug with a replaceable fuse to replace the fuse in the plug. If the plug with a replaceable fuse is externally connected with excessive electrical appliances, the internal fuse is burned out, it is inconvenient for the user having no tools at hand, who needs to replace the fuse of the plug as soon as possible. Therefore, a plug with a replaceable fuse is provided in the present invention, which is capable of ejecting, pushing, pulling, dragging the fuse out of the fuse socket merely through simple pressing or directly dragging by hand, without requiring a tool for installing or uninstalling.

SUMMARY OF THE INVENTION

The present invention provides a plug with a replaceable fuse, which is capable of ejecting, pushing, pulling, dragging the fuse out of the fuse socket merely through simple pressing or directly dragging by hand, without requiring a tool for installing or uninstalling. According to an embodiment of the present invention, the plug with a replaceable fuse disclosed in the present invention is further made as a plug capable of rectifying an alternating current into a direct current.

As embodied and broadly described herein, the present invention provides a plug with a replaceable fuse. The plug includes an outer housing, an inner core, a pair of prongs and a pair of conductive cords. The outer housing includes a fuse uninstall button opening and an inner core install opening. The inner core is installed in the outer housing through the inner core install opening. The inner core includes a fuse socket and a fuse uninstall button. The fuse socket has an uninstall opening. The fuse socket is used for disposing the fuse. The fuse uninstall button has one end extending to the uninstall opening, and the other end extending to the fuse uninstall button opening. The pair of prongs is installed in the inner core and extends from the inner core to out of the outer housing. The pair of conductive cords is installed in the inner core and extends from the inner core to out of the outer housing. When it is intended to replace the fuse, the fuse uninstall button is pressed from the fuse uninstall button opening. The fuse is ejected or pushed out of the fuse socket by one end of the fuse uninstall button extending to the uninstall opening. When the fuse uninstall button is not pressed, the fuse uninstall button restores to the original position, such that a new fuse is installed in the fuse socket.

The present invention provides a plug with a replaceable fuse. The plug includes an outer housing, an inner core, a pair of prongs and a pair of conductive cords. The outer housing includes an inner core install opening. The inner core is installed in the outer housing through the inner core install opening. The inner core includes a fuse socket and a fuse uninstall element. The fuse socket is used for disposing the fuse. The fuse uninstall element has one end connected with the inner core, and the other end for being dragged by the user, and the fuse uninstall element has a fuse placing part. The fuse placing part is used for placing the fuse. The pair of prongs is installed in the inner core and extends from the inner core to out of the outer housing. The pair of conductive cords is installed in the inner core and extends from the inner core to out of the outer housing. When it is intended to replace the fuse, the fuse is dragged out of the fuse socket by dragging the fuse uninstall element. The fuse is uninstalled from the fuse placing part, then a new fuse is installed at the fuse placing part, and the fuse uninstall element is pushed back to the fuse socket.

The present invention provides a plug with a replaceable fuse, which includes an outer housing, a pair of prongs, and a pair of prongs. The outer housing is a hollow outer housing, which includes an inner accommodation room and a fuse uninstall object. The inner accommodation room is formed with a fuse socket for disposing the fuse. The fuse uninstall object is used for pushing, ejecting, or dragging the fuse disposed in the fuse socket. The pair of prongs is embedded in the inner accommodation room and extends from the inner accommodation room out of the outer housing. The pair of conductive cords is embedded in the inner accommodation room and extends from the inner accommodation room out of the outer housing. The fuse disposed in the fuse socket is pushed, ejected, or dragged out of the fuse socket by pressing or directly dragging the fuse uninstall object.

According to the embodiment of the present invention, the plug further includes an electronic part socket for installing a circuit constituted by an electronic chip or an electronic part. The electronic chip can be a bridge rectifier, which makes the plug to become a plug capable of rectifying an alternating current into a direct current. The above circuit can be a voltage transformer circuit, which makes the plug to become a plug having a voltage transforming function.

Based on the above, the present invention provides a plug with a replaceable fuse. When it is intended to replace the fuse in the plug, the fuse can be pushed out of the fuse socket by simply pressing or directly dragging with hands, without using a tool for installing or uninstalling. The above plug includes a bridge rectifier therein, and the plug transforms the inputted an alternating current into a direct current. The plug further includes a voltage transformer circuit therein, and the plug transforms the inputted voltage into a voltage applicable for electrical appliance products.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The present invention provides a plug with a replaceable fuse. When it is intended to replace the fuse in the plug, the fuse can be pushed out from the fuse socket by simply pressing or directly dragging by hand, without using a tool for installing or uninstalling.

Figure 1:
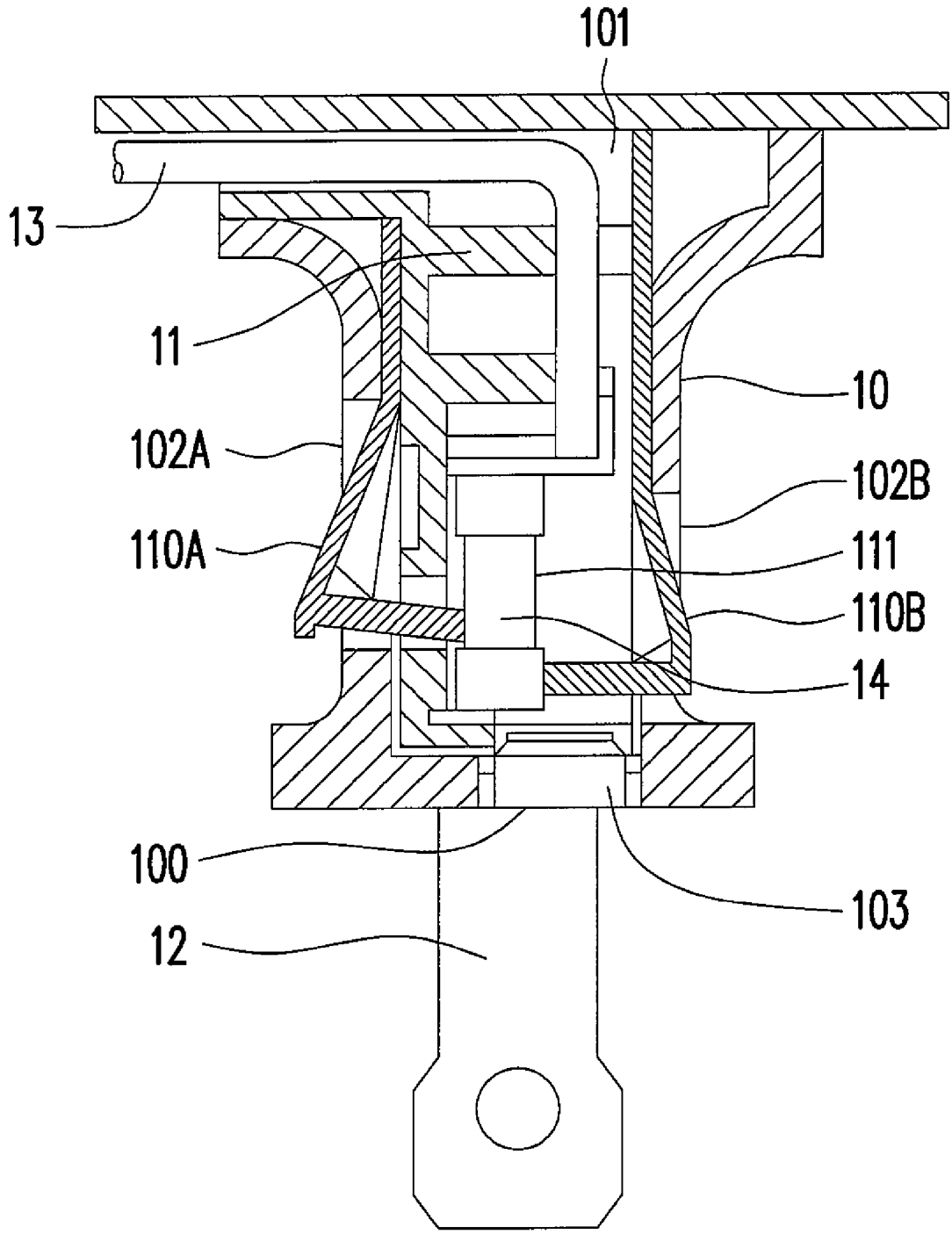
FIG. 1 (PRIOR ART)
FIG. 1 shows a plug with a replaceable fuse provided in U.S. Pat. No. 6,039,607.
Figure 2:
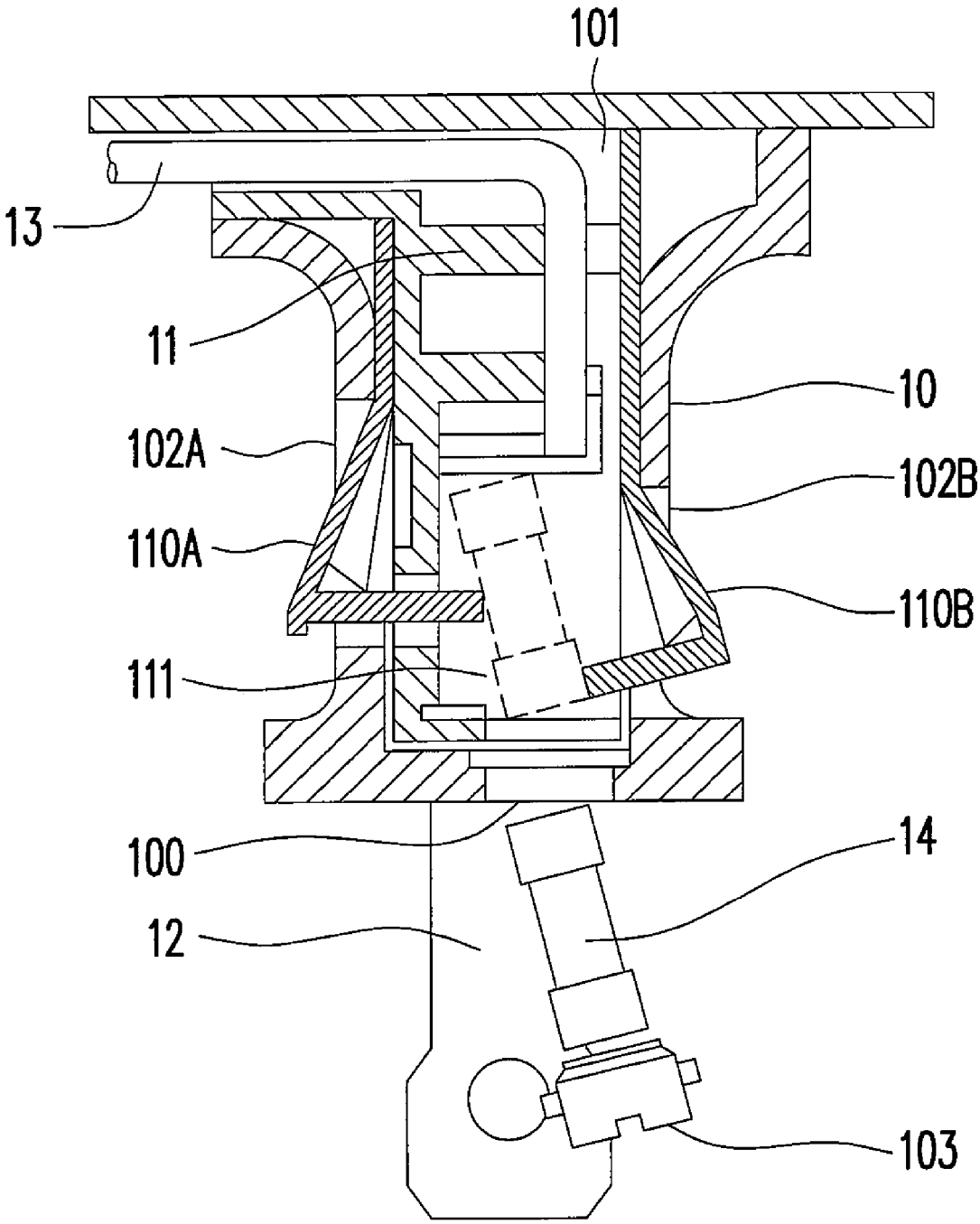
FIG. 2 (PRIOR ART)
FIG. 2 is a schematic view of a replacing method of the fuse 14 for the plug in FIG. 1.
Figure 3A:
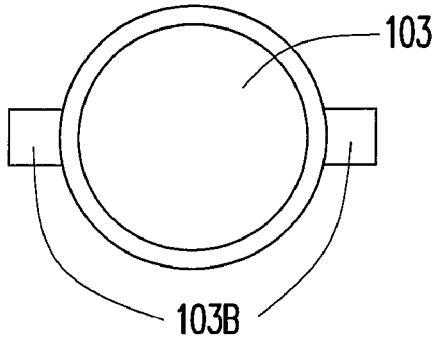
FIG. 3A (PRIOR ART)
FIG. 3A is a top view of the fuse socket cover 103.
Figure 3B:
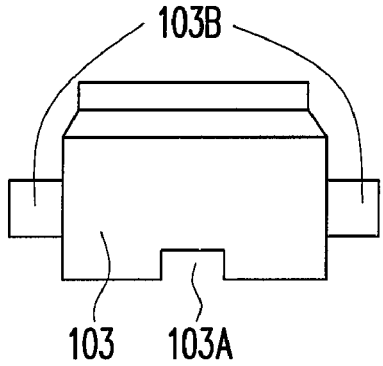
FIG. 3B (PRIOR ART)
FIG. 3B is a side view of the fuse socket cover 103.
Figure 3C:
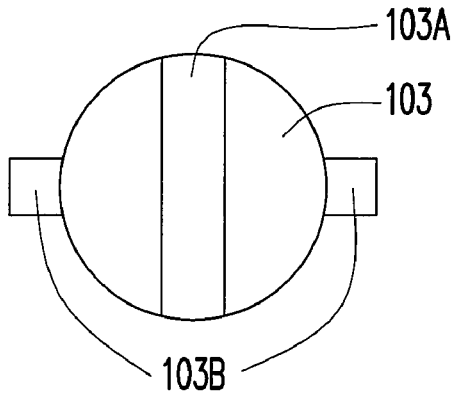
FIG. 3C (PRIOR ART)
FIG. 3C is a bottom view of the fuse socket cover 103.
Figure 4:
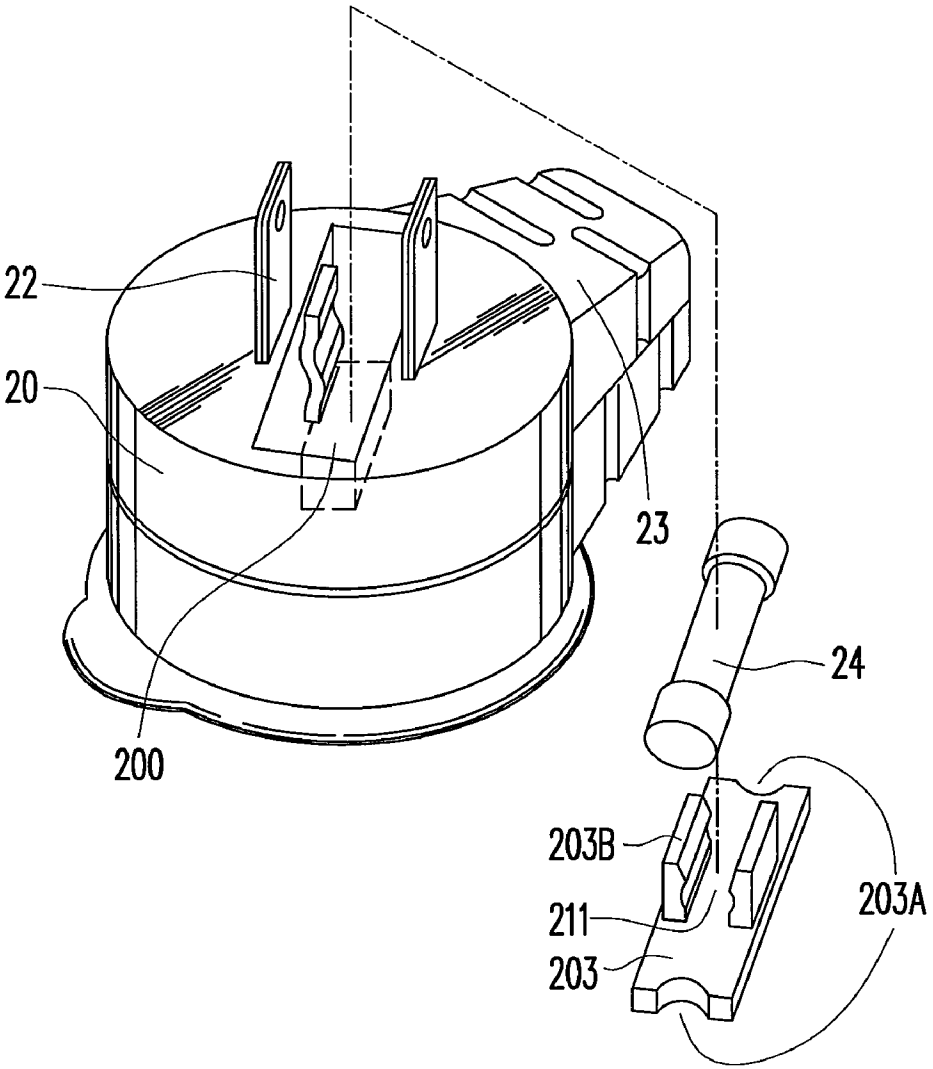
FIG. 4 (PRIOR ART)
FIG. 4 shows a plug with a replaceable fuse provided in U.S. Pat. No. 6,267,627.
Figure 5A:
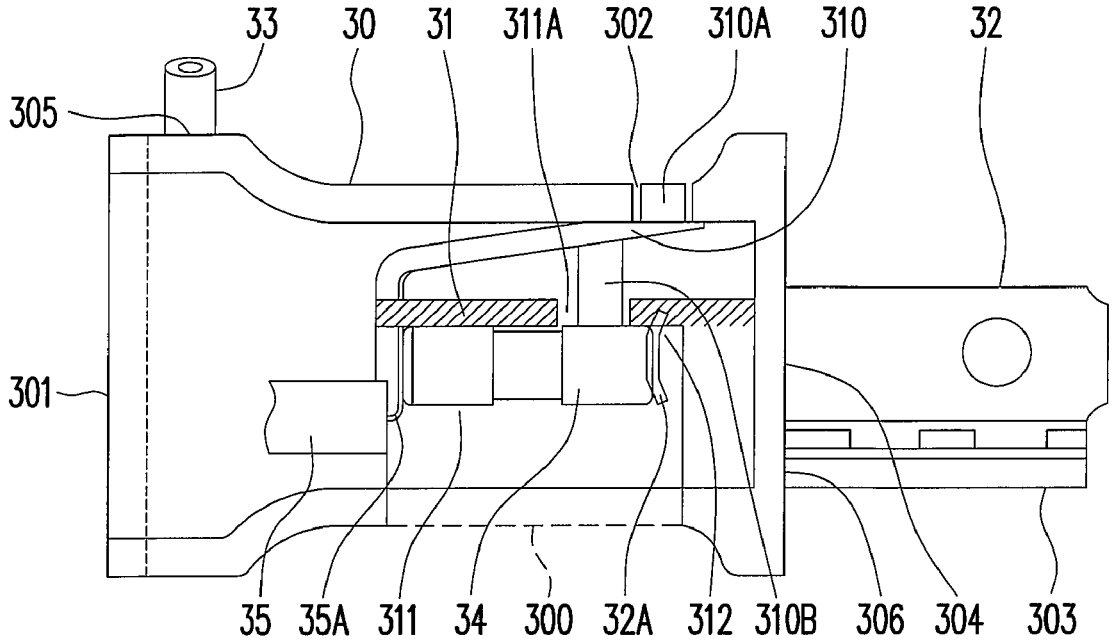
FIG. 5A shows an embodiment of the present invention.
Figure 5B:
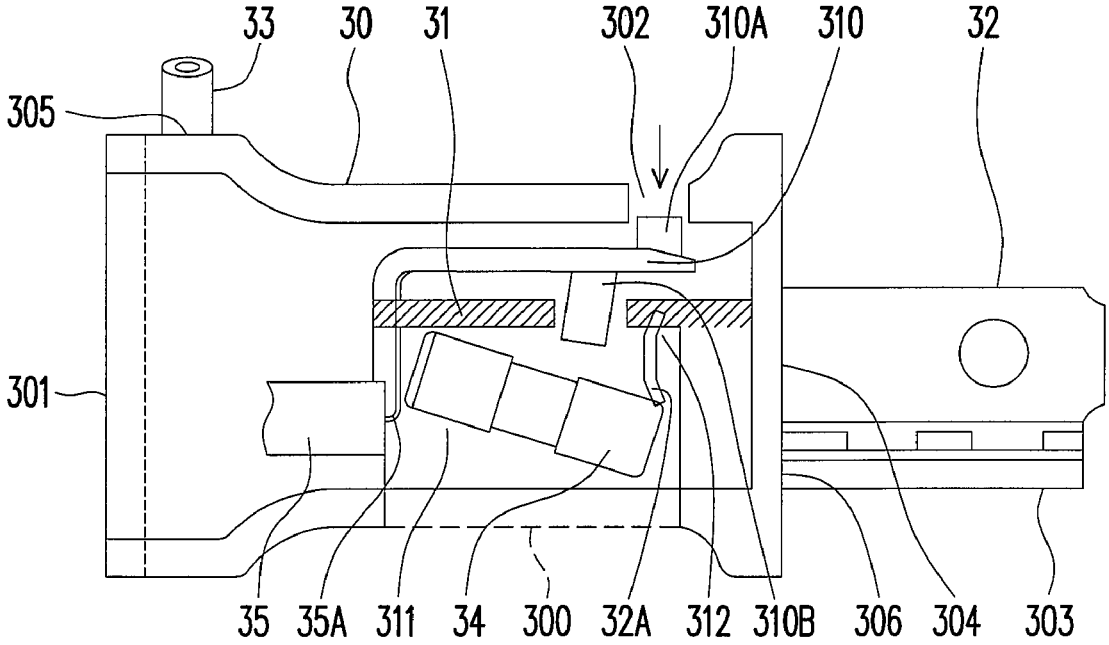
FIG. 5B is a schematic view of uninstalling the fuse 34 in FIG. 5A.

Referring to FIGS. 5A and 5B, FIG. 5A shows an embodiment of the present invention, and FIG. 5B is a schematic view of uninstalling the fuse 34 in FIG. 5A. The plug includes an outer housing 30, an inner core 31, a pair of prongs 32 and a pair of conductive cords 33. The outer housing 30 includes a fuse uninstall button opening 302 and an inner core install opening 301. The inner core 31 is installed in the outer housing 30 through the inner core install opening 301. The inner core 31 includes a fuse socket 311 and a fuse uninstall button 310. The fuse socket 311 is used for disposing the fuse 34. The fuse socket 311 has an uninstall opening 311A. The fuse uninstall button 310 has one end 310B extending to the uninstall opening 311A, and has the other end 310A extending to the fuse uninstall button opening 302. The pair of prongs 32 is installed in the inner core 31 and extends from the inner core 31 to out of the outer housing 30. The pair of conductive cords 33 is installed in the inner core 31 and extends from the inner core 31 to out of the outer housing 30. When it is intended to replace the fuse 34, the fuse uninstall button 310 is pressed from the fuse uninstall button opening 302. The fuse 34 is ejected or pushed out of the fuse socket 311 by one end 310B of the fuse uninstall button 310 extending to the uninstall opening 311A. When the fuse uninstall button 310 is not pressed, the fuse uninstall button 310 restores to the original position, such that a new fuse 34 is installed in the fuse socket 311. As shown in FIGS. 5A and 5B, the fuse uninstall button 310 in this embodiment is a plastic elastic button.

Referring to FIGS. 5A and 5B, the outer housing 30 further includes a fuse socket opening 300, a pair of prong openings 304, a pair of conductive cord openings 305, a push cover opening 306, and a push cover 303. The fuse socket opening 300 is used for moving the fuse 34 released from the fuse socket 311 out of the outer housing 30, or moving a new fuse 34 into the outer housing 30. The installed pair of prongs 32 extends to out of the outer housing 30 through the pair of prong openings 304. The installed pair of conductive cords 33 extends to out of the outer housing 30 through the pair of conductive cord openings 305. The push cover 303 is pushed in or out, so as to close or open the fuse socket opening 300. The push cover opening 306 is used for installing the push cover 303. The inner core 31 further includes a pair of prong sockets 312 (see FIG. 6), a pair of conductive cord sockets 313 (see FIG. 6), and an electronic part socket 314 (see FIG. 6). The pair of prong sockets 312 is used for installing the pair of prongs 32. The pair of conductive cord sockets 313 is used for installing the pair of conductive cords 33. The pair of conductive cord sockets 313 has a conductive cord conductor for conducting a loop between the installed fuse 34 and the pair of conductive cords 33. The pair of prong sockets 312 has a prong conductor 32A for conducting a loop between the installed fuse 34 and the pair of prongs 32. The electronic part socket 314 is used for installing an electronic chip or a circuit constituted by electronic components. In the embodiment of FIGS. 5A and 5B, a bridge rectifier 35 is inserted into the electronic part socket 314, and a pin 35A of the bridge rectifier 35 is coupled to the installed fuse 34.

In the plug with a replaceable fuse according to the above embodiment of the present invention, the fuse 34 can be easily replaced by pressing the fuse uninstall button 310 with hands. By utilizing the rectifying function of the bridge rectifier 35, the plug provided in the present invention has a function of rectifying an alternating current (AC) into a direct current (DC).

Figure 6:
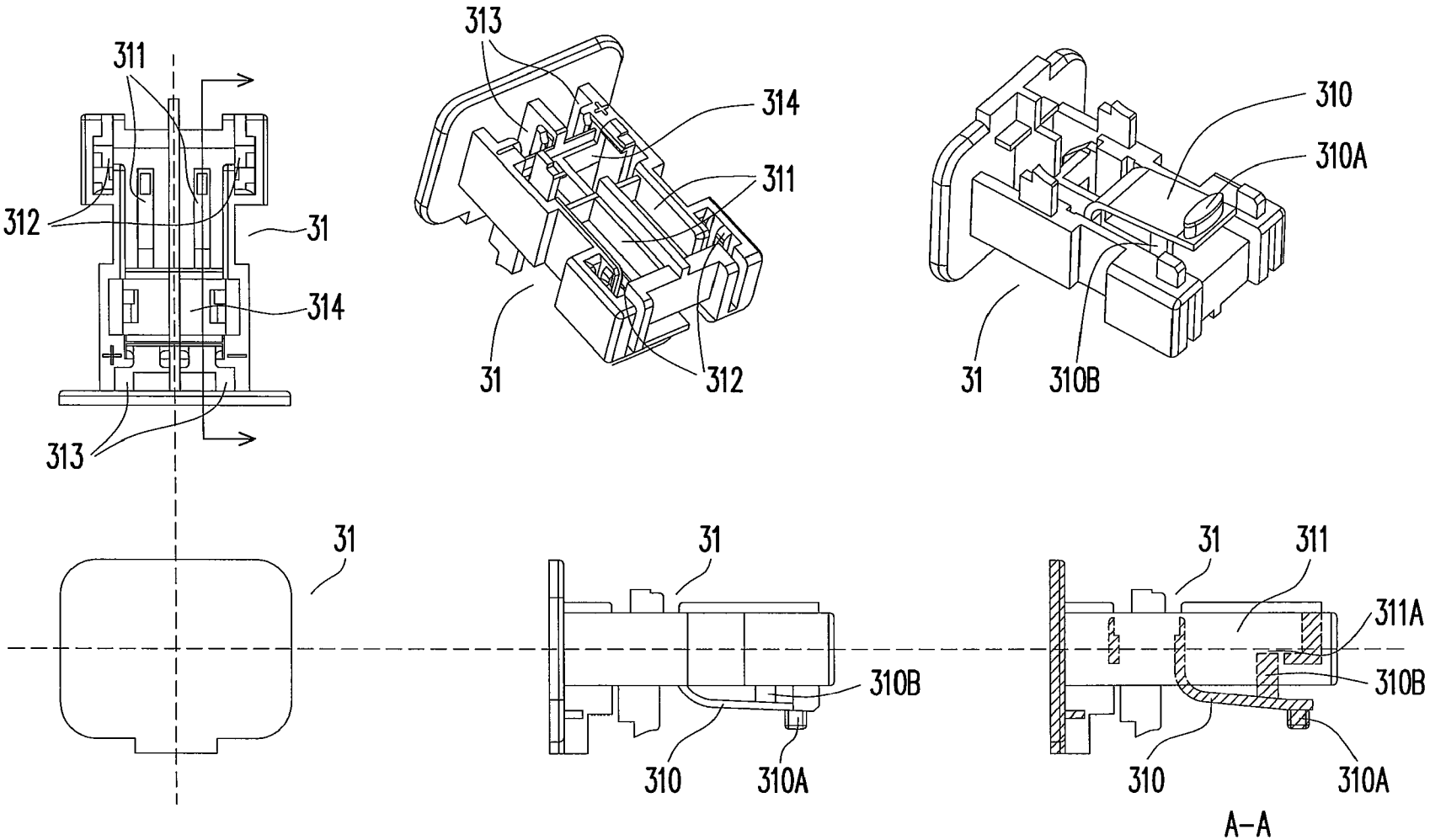
FIG. 6 is a sectional view of an inner core 31.

FIG. 6 is a sectional view of an inner core 31. The inner core 31 has a fuse socket 311, a fuse uninstall button 310, a pair of prong sockets 312, a pair of conductive cord sockets 313, and an electronic part socket 314. The fuse socket 311 has an uninstall opening 311A. The functions and connection relationships of the components are given as the above.

Figure 7:
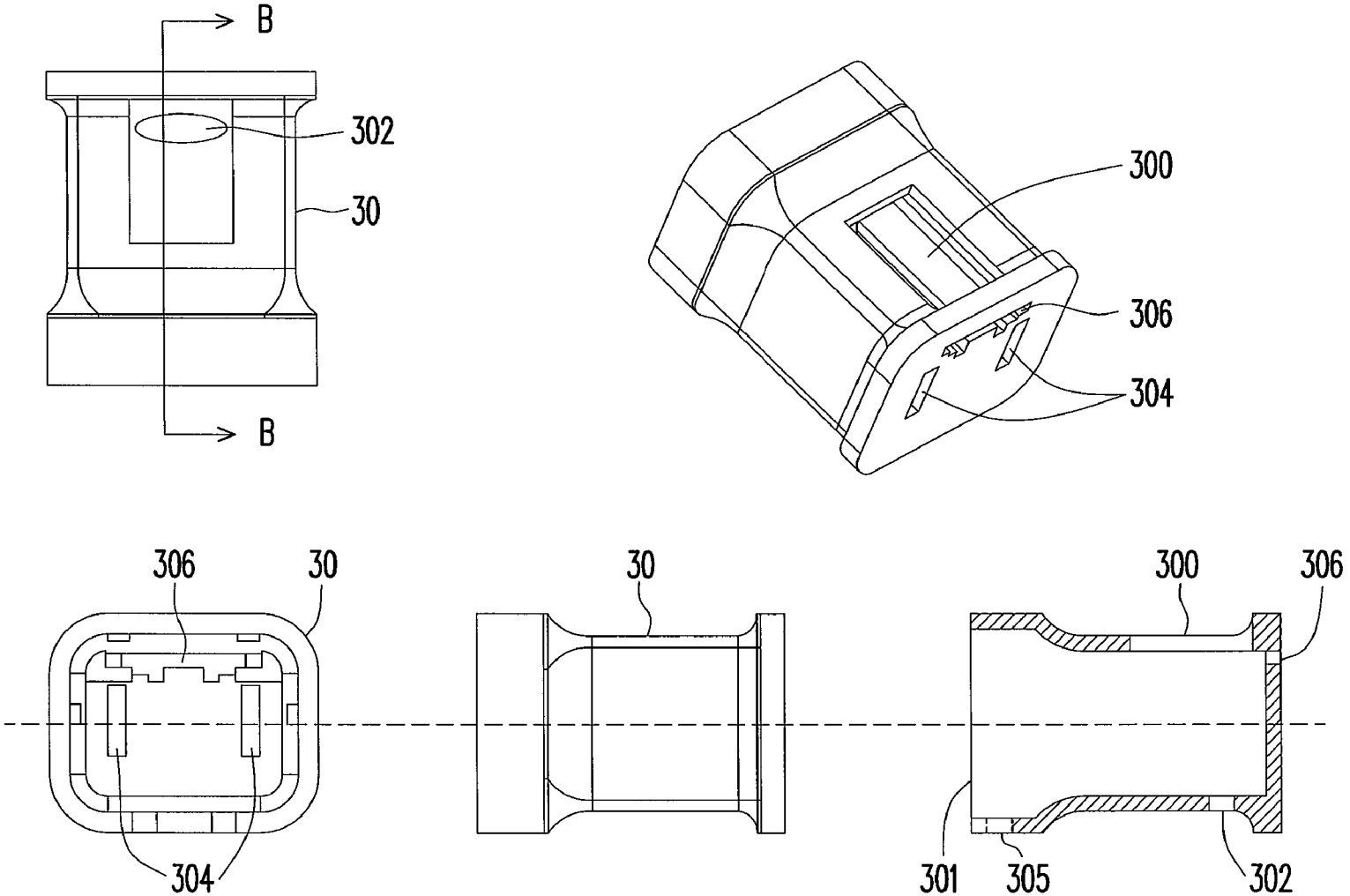
FIG. 7 is a sectional view of an outer housing 30.
Figure 8:
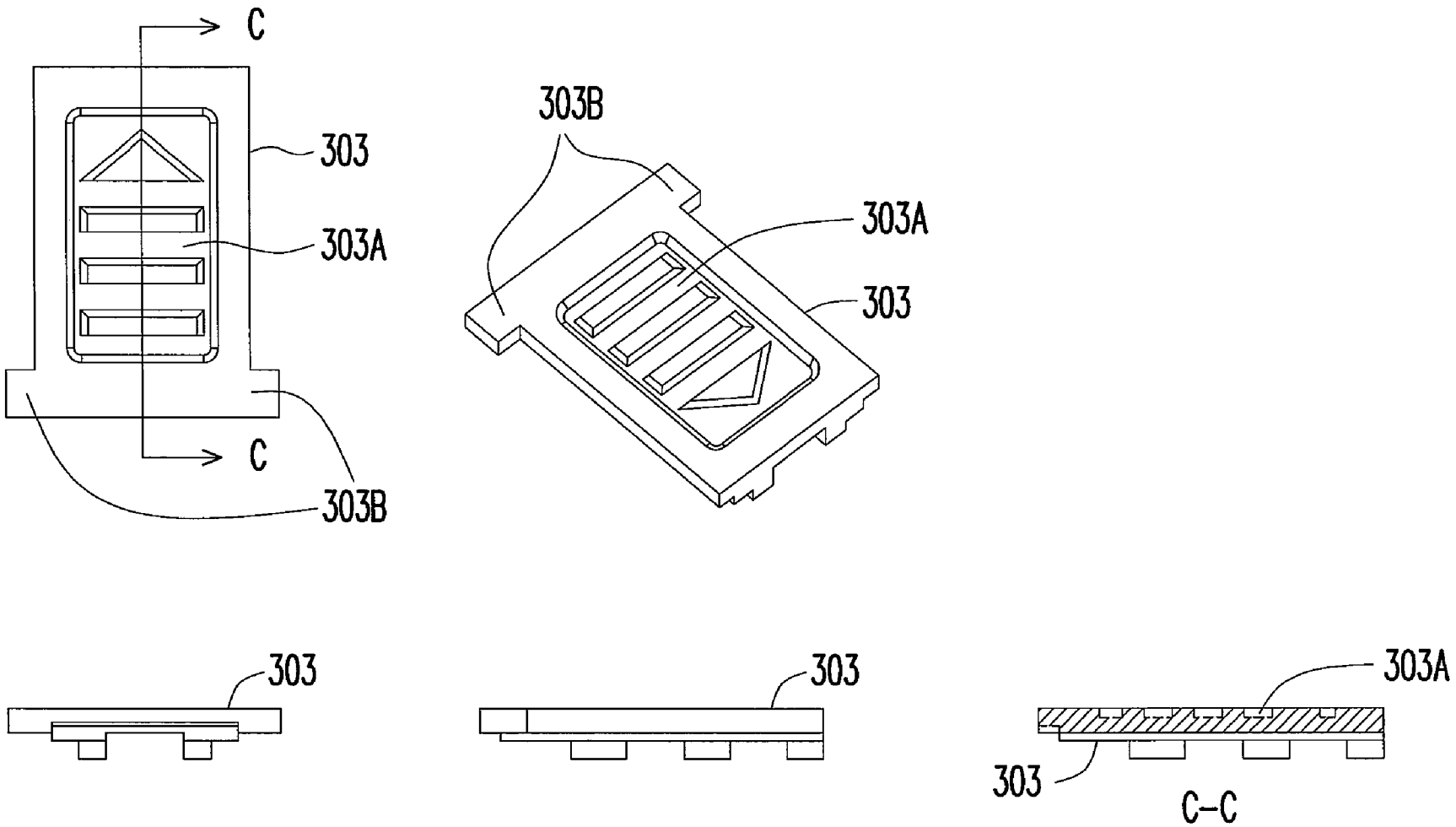
FIG. 8 is a sectional view of a fuse push cover 303.

Referring to FIGS. 7 and 8, FIG. 7 is a sectional view of an outer housing 30, and FIG. 8 is a sectional view of a push cover 303 of the fuse socket. The outer housing 30 includes a fuse uninstall button opening 302, an inner core install opening 301, a fuse socket opening 300, a pair of prong openings 304, a pair of conductive cord openings 305, a push cover opening 306, and a push cover 303. The push cover 303 of the fuse socket has a push surface 303A on the surface for facilitating the user to push the push cover 303. The push cover 303 further has an engaging part 303B for preventing the push cover 303 from being dragged out of the push cover opening 304 when being pushed out. Other functions and connection relationship of the components are given as the above.

Figure 9:
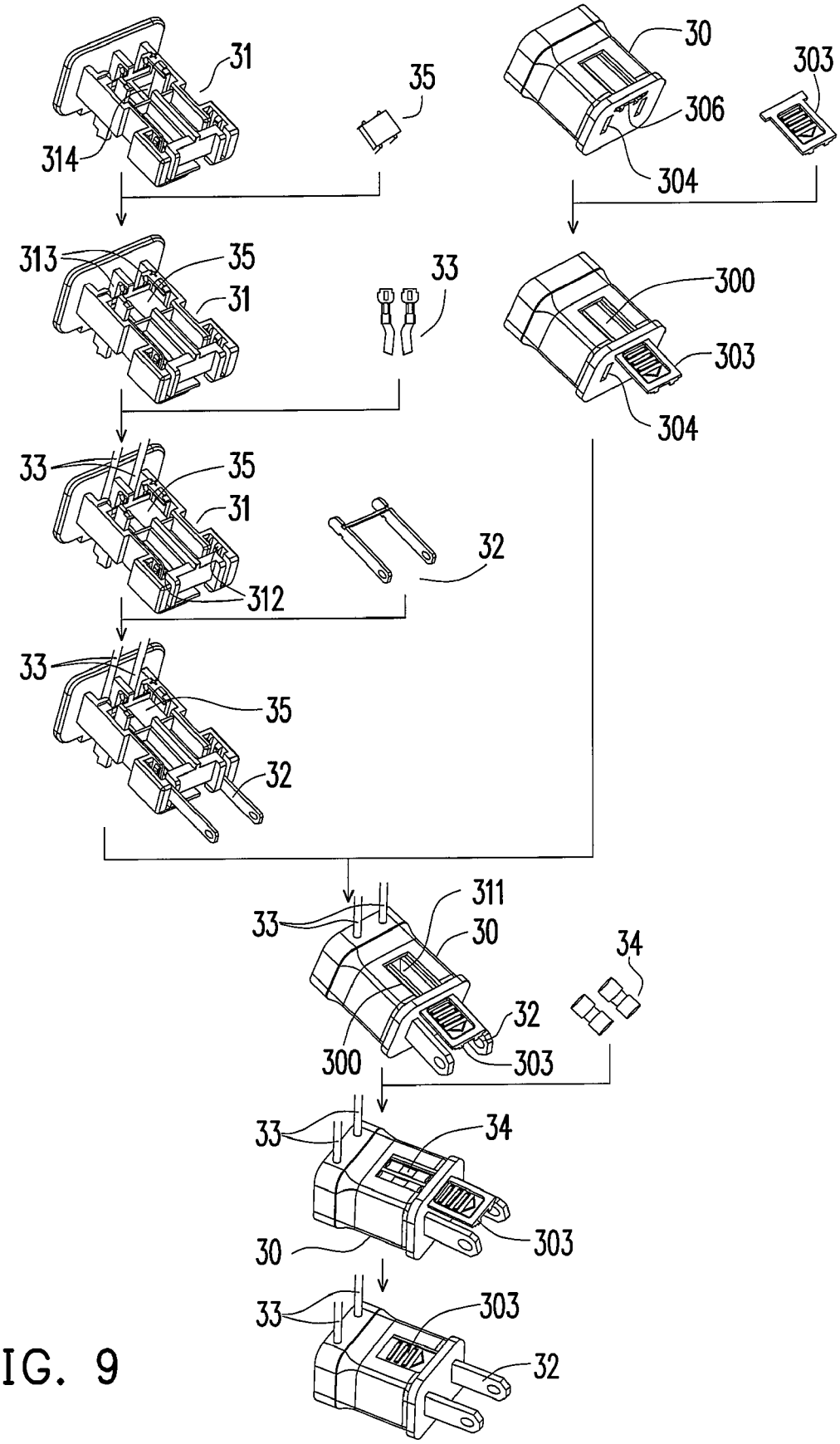
FIG. 9 is a schematic view of installing the plug in the embodiment of FIG. 5.
Figure 10A:
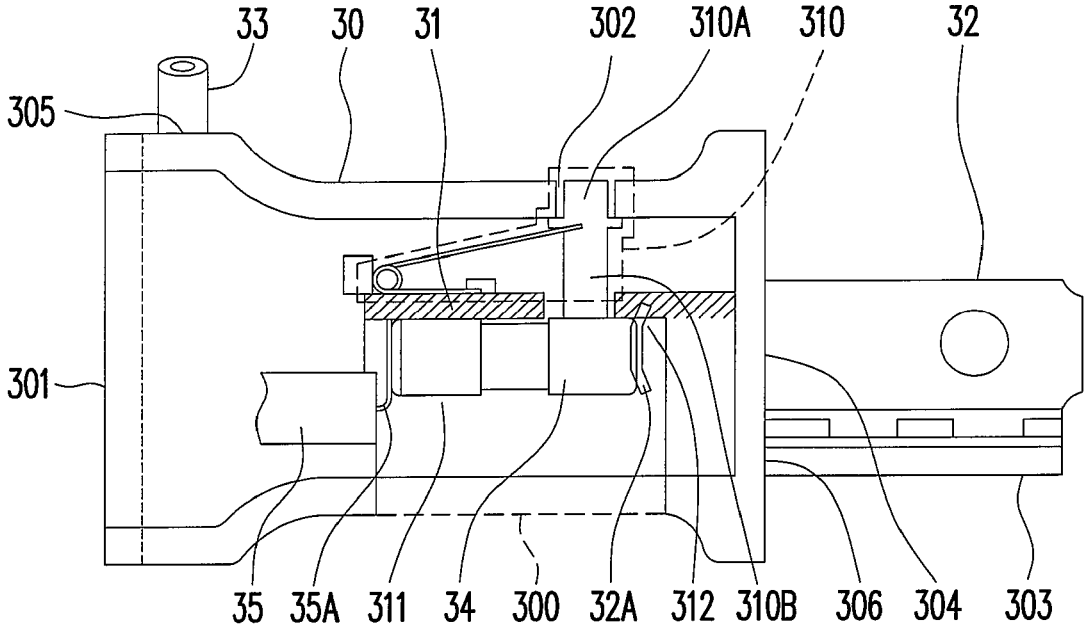
FIG. 10A shows another embodiment of the present invention.
Figure 10B:
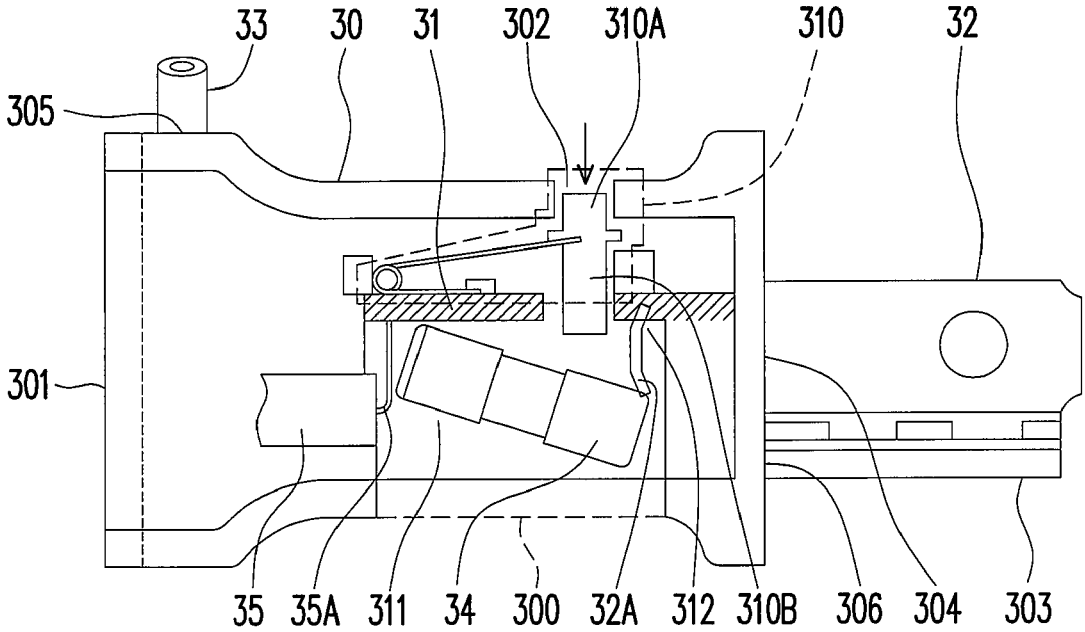
FIG. 10B is a schematic view of uninstalling the fuse 34 in FIG. 10A.

FIG. 9 is a schematic view of installing the plug in the embodiment of FIG. 5. First, a bridge rectifier 35 is installed in the electronic part socket 314 of the inner core 31 (see the left and top side of FIG. 9). Then, the conductive cords 33 are installed into the conductive cord sockets 313. The prongs 32 are installed into the prong sockets 312. Then, the push cover 303 is installed into the push cover opening 306 through the inner core installed opening 301 (see the right and top side of FIG. 9). Then, the inner core 31 is installed into the outer housing 30 through the inner core installed opening 301. Finally, the fuse 34 is installed to the fuse socket 311 through the fuse socket opening 300 (see the middle side of FIG. 9), and the fuse socket opening 300 is covered with the push cover 303, so as to accomplish the installing of the plug.

Figure 11A:
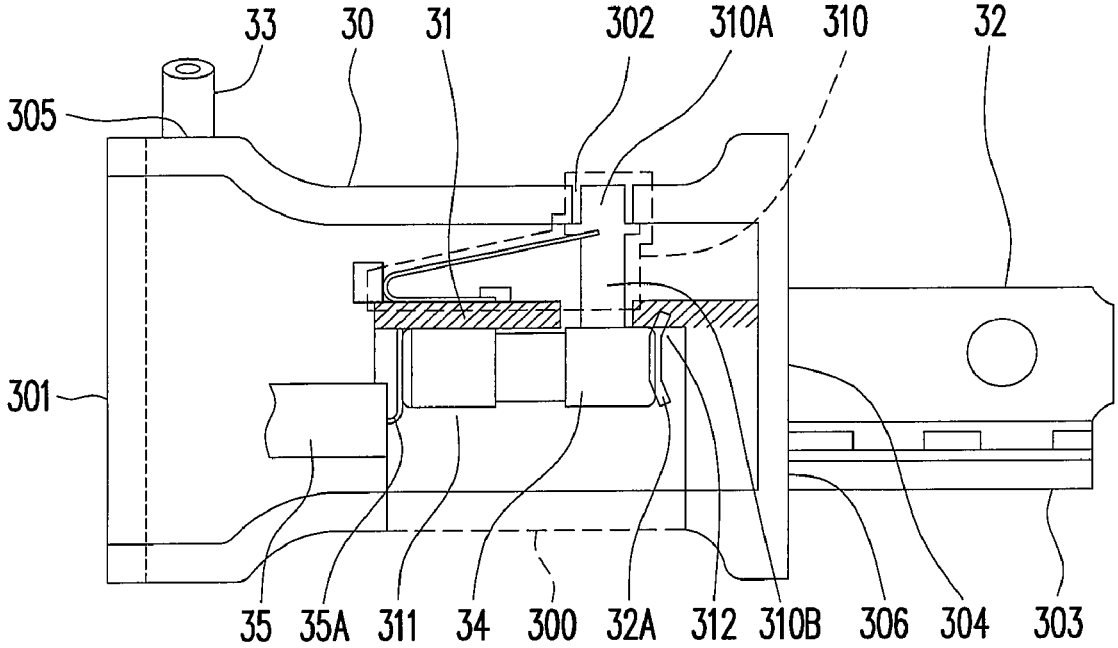
FIG. 11A shows another embodiment of the present invention.
Figure 11B:
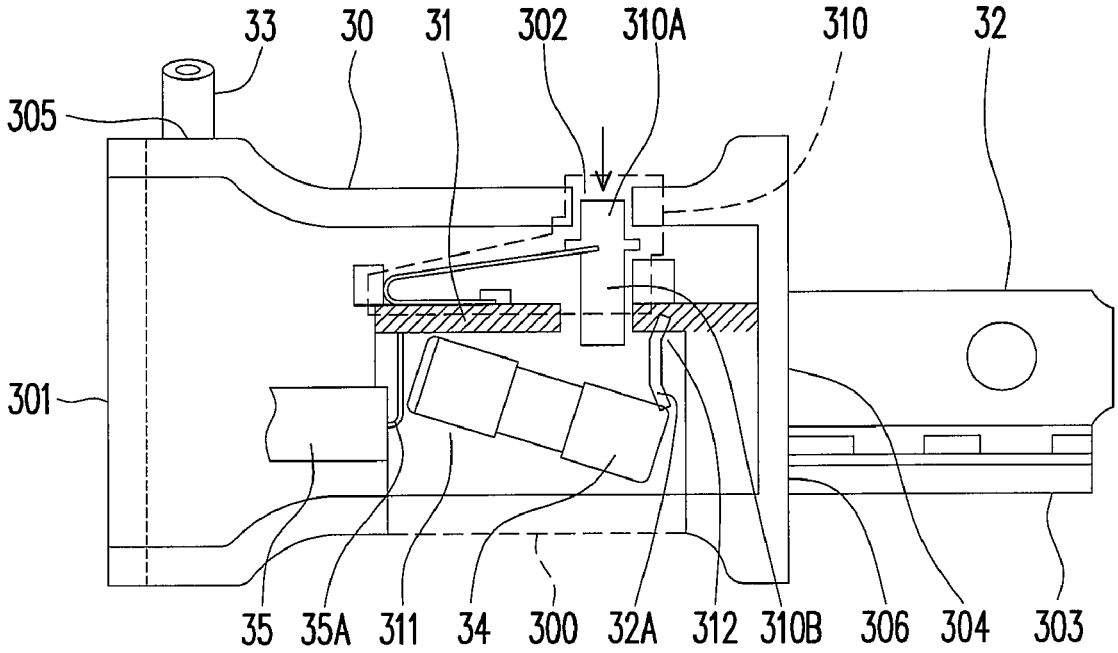
FIG. 11B is a schematic view of uninstalling the fuse 34 in FIG. 11A.
Figure 12A:
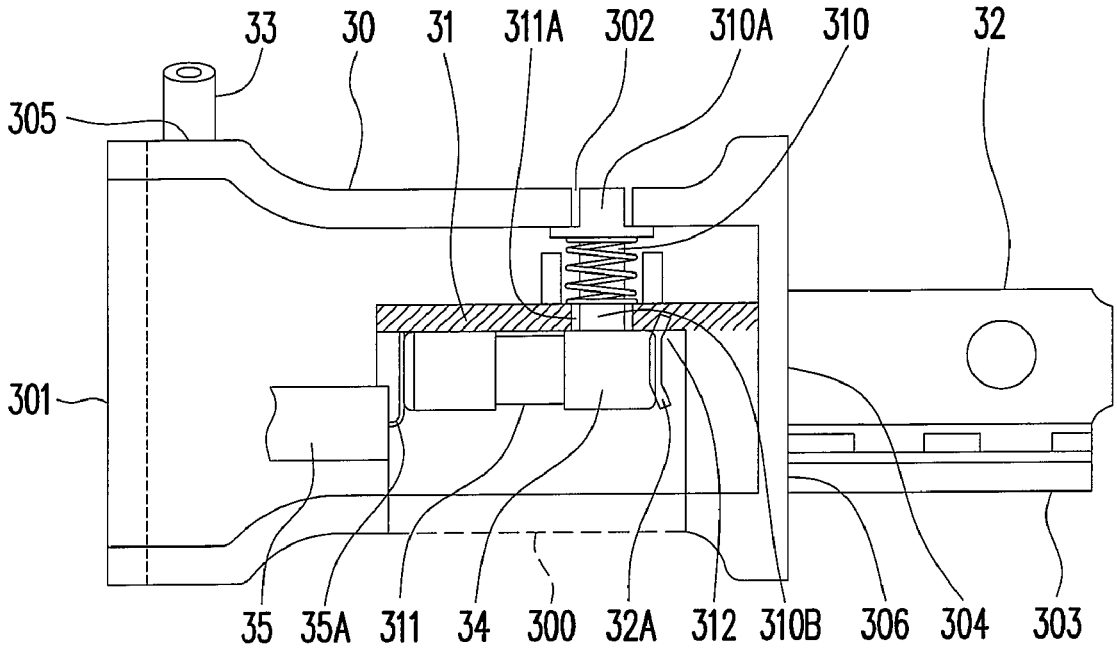
FIG. 12A shows another embodiment of the present invention.
Figure 12B:
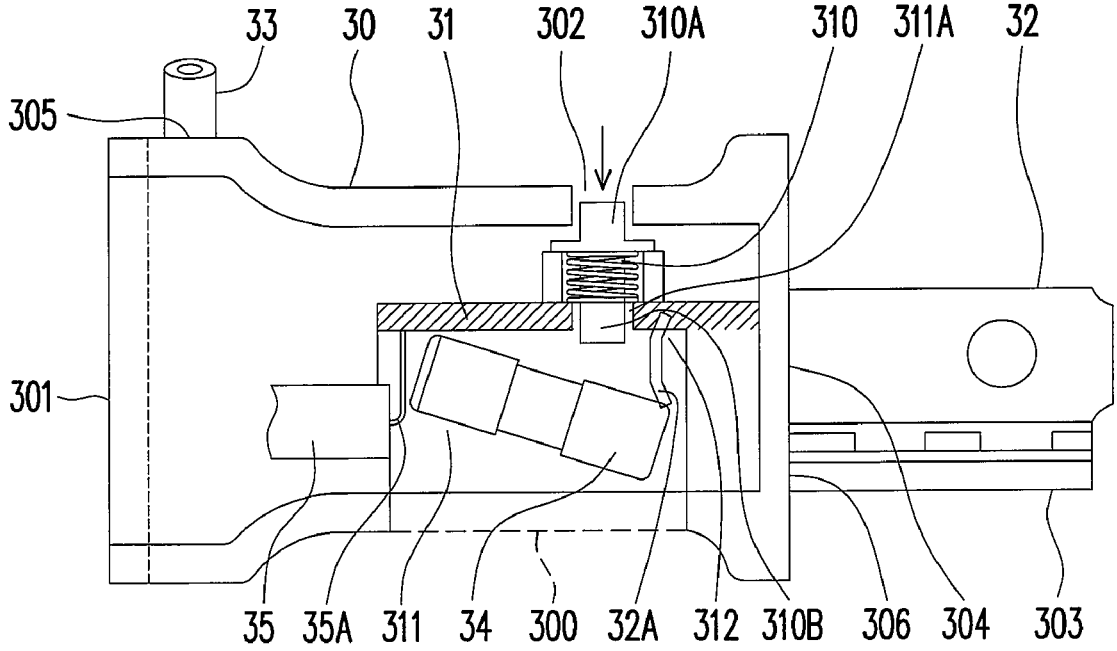
FIG. 12B is a schematic view of uninstalling the fuse 34 in FIG. 12A.

The above fuse uninstall button 310 of the plug in FIG. 5 is a plastic elastic button. The fuse uninstall button 310 can also be a spring button (see FIG. 10A, 10B, and FIGS. 12A and 12B), or a spring blade button (FIGS. 11A and 11B).

Figure 13A:
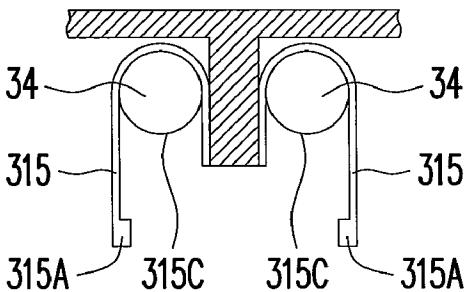
FIG. 13A shows another embodiment of the present invention.
Figure 13A:
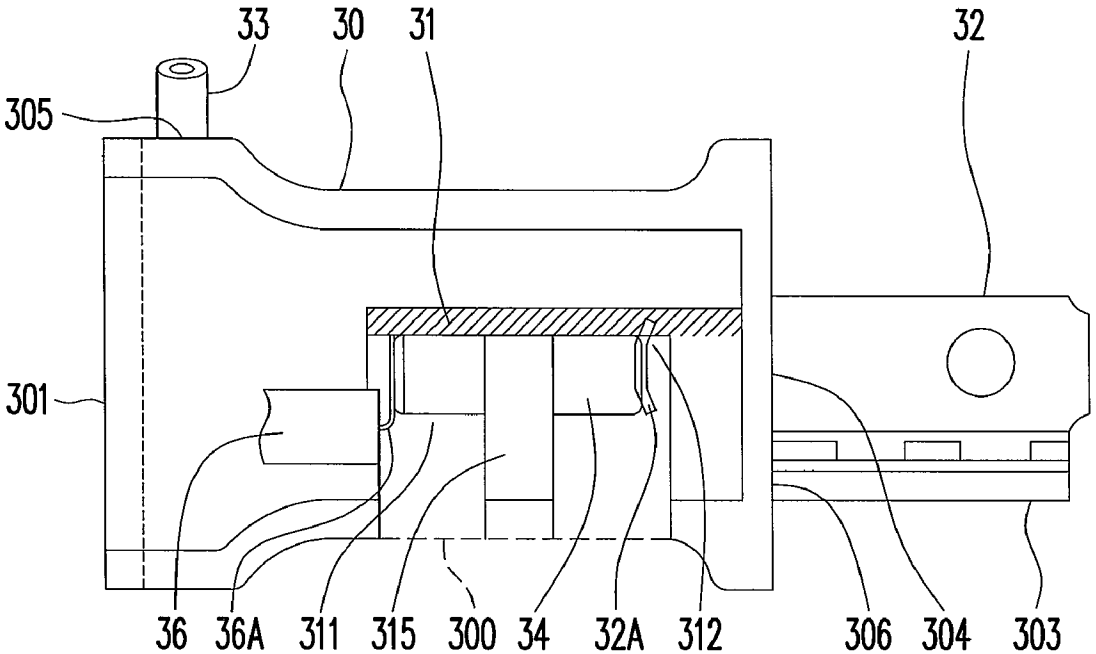
Figure 13B:
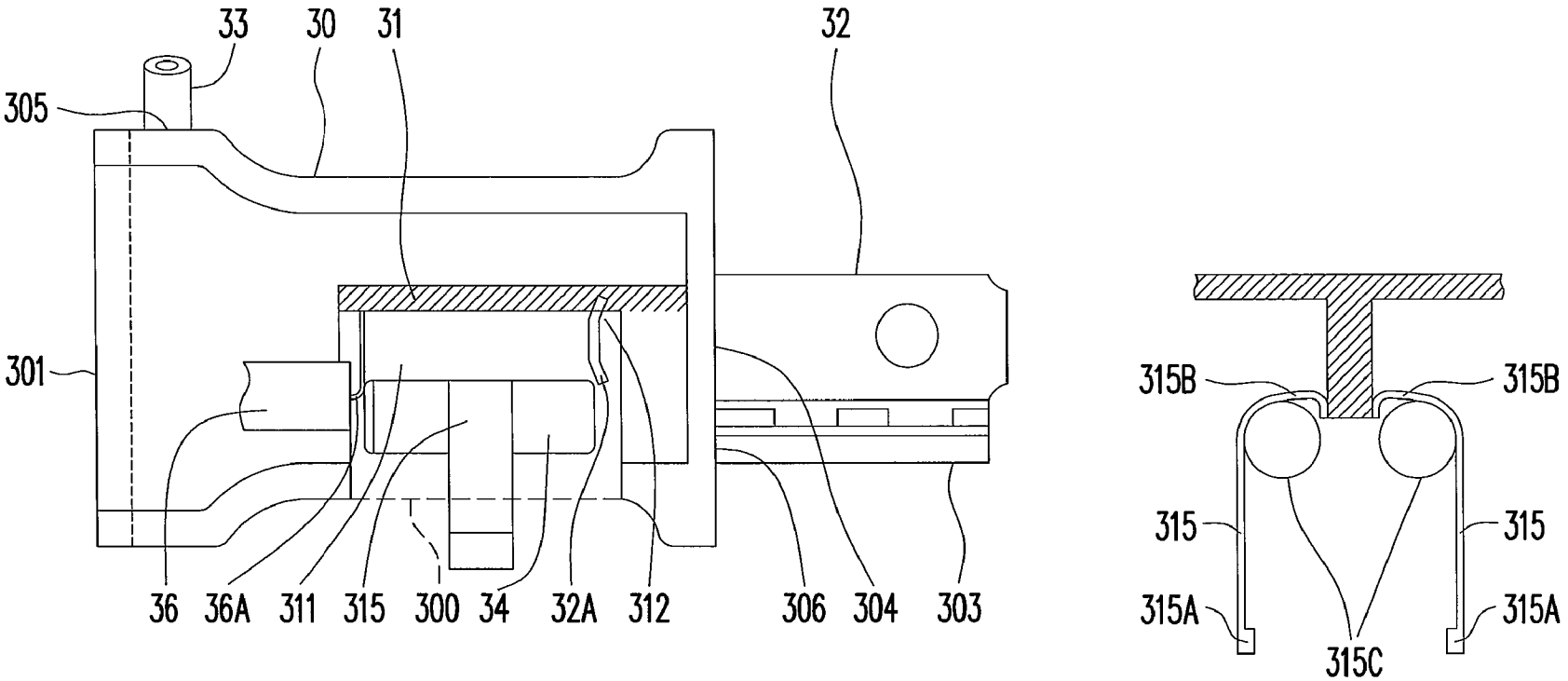
FIG. 13B is a schematic view of uninstalling the fuse 34 in FIG. 13A.

Referring to FIGS. 13A and 13B, FIG. 13A shows an embodiment of the present invention, and FIG. 13B is a schematic view of uninstalling the fuse 34 in FIG. 13A. The plug includes an outer housing 30, an inner core 31, a pair of prongs 32 and a pair of conductive cords 33. The outer housing 30 includes an inner core install opening 301. The inner core 31 is installed into the outer housing 30 through the inner core install opening 301. The inner core 31 includes a fuse socket 311 and a fuse uninstall element 315. The fuse socket 311 is used for disposing the fuse 34. The fuse uninstall element 315 has one end 315B being connected with the inner core 31, and has the other end 315A for being dragged by the user, and the fuse uninstall element 315 has a fuse placing part 315C. The fuse placing part 315C is used for placing the fuse 34. The pair of prongs 32 is installed in the inner core 31 and extends from the inner core 31 to out of the outer housing 30. The pair of conductive cords 33 is installed in the inner core 31 and extends from the inner core 31 to out of the outer housing 30. When it is intended to replace the fuse 34, the fuse uninstall element 315 is dragged. The fuse 34 is dragged out of the fuse socket 311, and is uninstalled from the fuse placing part 315C. A new fuse 34 is installed at the fuse placing part 315C, and the fuse uninstall element 315 is pushed back to the fuse socket 311, so as to accomplish the replacing. As shown in FIGS. 13A and 13B, the fuse uninstall element 315 in this embodiment is a soft drag element.

Referring to FIGS. 13A and 13B, the outer housing 30 further includes a fuse socket opening 300, a pair of prong openings 304, a pair of conductive cord openings 305, a push cover opening 306, and a push cover 303. The fuse socket opening 300 is used for moving the fuse 34 released from the fuse socket 311 out of the outer housing 30, or moving a new fuse 34 into the outer housing 30. The installed pair of prongs 32 extends to out of the outer housing 30 through the pair of prong openings 304. The installed pair of conductive cords 33 extends to out of the outer housing 30 through the pair of conductive cord openings 305. The push cover 303 is pushed in or out, so as to close or open the fuse socket opening 300. The push cover opening 306 is used for installing the push cover 303. The inner core 31 further includes a pair of prong sockets 312 (see FIG. 6), a pair of conductive cord sockets 313 (see FIG. 6), and an electronic part socket 314 (see FIG. 6). The pair of prong sockets 312 is used for installing the pair of prongs 32. The pair of conductive cord sockets 313 is used for installing the pair of conductive cords 33. The pair of conductive cord sockets 313 has a conductive cord conductor for conducting a loop between the installed fuse 34 and the pair of conductive cords 33. The pair of prong sockets 312 has a prong conductor 32A for conducting a loop between the installed fuse 34 and the pair of prongs 32. The electronic part socket 314 is used for installing an electronic chip or a circuit constituted by electronic components. In the embodiment of FIGS. 13A and 13B, a voltage transformer circuit 36 is inserted into the electronic part socket 314, and a pin 36A of the circuit 36 is coupled to the installed fuse 34.

Figure 14A:
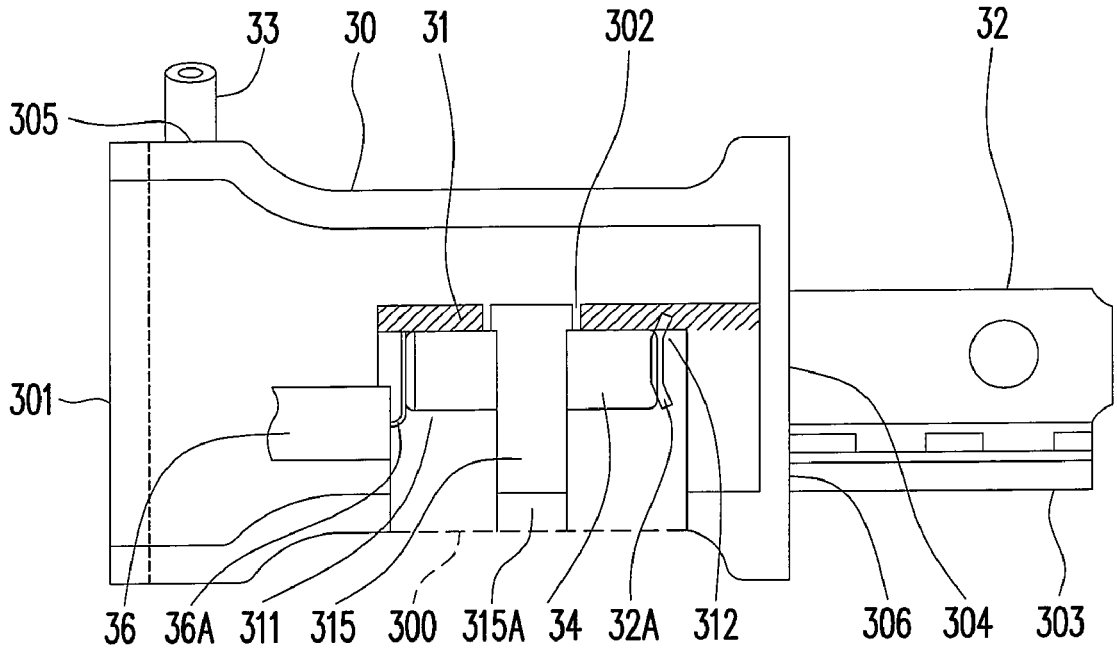
FIG. 14A shows another embodiment of the present invention.
Figure 14B:
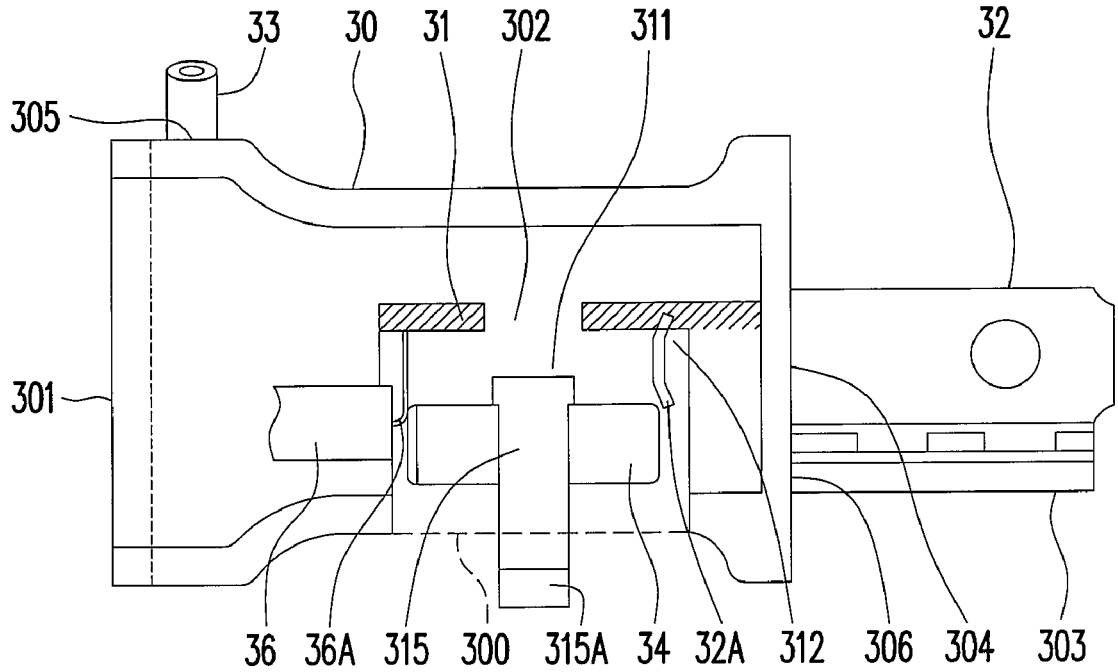
FIG. 14B is a schematic view of uninstalling the fuse 34 in FIG. 14A.

The above fuse uninstall element 315 of the plug can also be a hard drag element (see FIGS. 14A and 14B). See FIGS. 14A and 14B, in the embodiment, the fuse uninstall element 315 has one end 315A for being dragged by the user, and the fuse uninstall element 315 forms a fuse placing part for placing the fuse 34.

In the plug with a replaceable fuse according to the above embodiment of the present invention, the fuse 34 can be easily replaced by dragging the fuse uninstall element 315 by hand. By utilizing the voltage transform function of the voltage transformer circuit 36, the plug provided in the present invention has a function of transforming the inputted voltage into a voltage desired by electrical appliances.

To sum up, the present invention provides a plug with a replaceable fuse, in which the fuse can be pushed out of the fuse socket by simply pressing or directly dragging by hand, without requiring a tool for installing or uninstalling. The above plug includes a bridge rectifier therein, which thus is capable of transforming the inputted AC current into a DC current. The plug further includes a voltage transformer circuit therein, which thus is capable of transforming the input voltage into a voltage applicable for electrical appliance products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plug with a replaceable fuse, comprising:

an outer housing, comprising:

a fuse uninstall button opening; and an inner core install opening;

an inner core, installed into the outer housing through the inner core install opening, the inner core comprising:

a fuse socket, for disposing the fuse, and having an uninstall opening; and a fuse uninstall button in an original position, having one end extending to the uninstall opening, having an other end extending to the fuse uninstall button opening and having a plastic elastic portion, a spring elastic portion, or a spring blade elastic portion between the one end and the other end of the fuse uninstall button;

a pair of prongs, installed in the inner core, and extending from the inner core to out of the outer housing; and a pair of conductive cords, installed in the inner core, and extending from the inner core to out of the outer housing, wherein, when it is intended to replace the fuse, the other end of the fuse uninstall button is pressed from the fuse uninstall button opening, the fuse is ejected or pushed out of the fuse socket by the one end of the fuse uninstall button extending through the uninstall opening; when the fuse uninstall button is released, the elastic portion, spring elastic portion, or spring blade elastic portion automatically restores the fuse uninstall button to the original position, such that a new fuse is capable of being installed into the fuse socket.

2. The plug with the replaceable fuse as claimed in claim 1, wherein the outer housing further comprises:

a fuse socket opening, for moving the fuse released from the fuse socket out of the outer housing, or moving a new fuse into the outer housing;

a pair of prong openings, wherein the pair of prongs extends to out of the outer housing through the pair of prong openings; and a pair of conductive cord openings, wherein the pair of conductive cords extends to out of the outer housing through the pair of conductive cord openings.

3. The plug with the replaceable fuse as claimed in claim 2, further comprising a push cover, for being pushed in or out, so as to close or open the fuse socket opening, wherein the outer housing further comprises a push cover opening, for installing the push cover.

4. The plug with the replaceable fuse as claimed in claim 1, wherein the inner core further comprises:

a pair of prong sockets, for installing the pair of prongs; and a pair of conductive cord sockets, for installing the pair of conductive cords;

wherein, the pair of conductive cord sockets has a conductive cord conductor for conducting a loop between the installed fuse and the pair of conductive cords, and the pair of prong sockets has a prong conductor for conducting a loop between the installed fuse and the pair of prongs.

5. The plug with the replaceable fuse as claimed in claim 4, wherein the inner core further comprises an electronic part socket for installing an electronic chip or a circuit constituted by electronic components.

6. The plug with the replaceable fuse as claimed in claim 5, wherein the electronic chip is a bridge rectifier coupled to the installed fuse.

7. The plug with the replaceable fuse as claimed in claim 5, wherein the circuit is a voltage transformer circuit coupled to the installed fuse.

8. A plug with a replaceable fuse, comprising:

a hollow outer housing, comprising:

an inner accommodation room, having a fuse socket for disposing the fuse; and a fuse uninstall object in an original position, having one end for pushing or ejecting the fuse disposed in the fuse socket, having an other end for being pressed, and having a plastic elastic portion, a spring elastic portion, or a spring blade elastic portion between the one end and the other end of the fuse uninstall object;

a pair of prongs, embedded in the inner accommodation room, and extending from the inner accommodation room out of the hollow outer housing; and a pair of conductive cords, embedded in the inner accommodation room, and extending from the inner accommodation room out of the hollow outer housing, wherein, the fuse disposed in the fuse socket is pushed or ejected by the one end of the fuse uninstall object out of the fuse socket by pressing the other end of the fuse uninstall object; and after the fuse uninstall object is pressed to uninstall the fuse, the plastic elastic portion, spring elastic portion, or spring blade elastic portion of the fuse uninstall object automatically restores the fuse uninstall object to the original position after the fuse uninstall object is released, such that a new fuse is capable of being installed into the fuse socket.

9. The plug with the replaceable fuse as claimed in claim 8, wherein the hollow outer housing further comprises:

a fuse socket opening, for moving the fuse released from the fuse socket out of the hollow outer housing, or moving a new fuse into the hollow outer housing;

a pair of prong openings, wherein the pair of prongs extends to out of the hollow outer housing through the pair of prong openings; and a pair of conductive cord openings, wherein the pair of conductive cords extends to out of the hollow outer housing through the pair of conductive cord openings.

10. The plug with the replaceable fuse as claimed in claim 8, further comprising a push cover, for being pushed in or out, so as to close or open the fuse socket opening, wherein the hollow outer housing further comprises a push cover opening, for installing the push cover.

11. The plug with the replaceable fuse as claimed in claim 8, wherein the inner accommodation room comprises:

a pair of prong sockets, for installing the pair of prongs; and a pair of conductive cord sockets, for installing the pair of conductive cords;

wherein, the pair of conductive cord sockets has a conductive cord conductor for conducting a loop between the installed fuse and the pair of conductive cords, and the pair of prong sockets has a prong conductor for conducting a loop between the installed fuse and the pair of prongs.

12. The plug with the replaceable fuse as claimed in claim 11, wherein the inner accommodation room further comprises an electronic part socket for installing an electronic chip or a circuit constituted by electronic components.

13. The plug with the replaceable fuse as claimed in claim 12, wherein the electronic chip is a bridge rectifier coupled with the installed fuse.

14. The plug with the replaceable fuse as claimed in claim 12, wherein the circuit is a voltage transformer circuit coupled to the installed fuse.

* * * * *